US011427355B2

(12) United States Patent
Tan et al.

(10) Patent No.: US 11,427,355 B2
(45) Date of Patent: Aug. 30, 2022

(54) MEASURING DEVICE OF CHINESE MEDICINE GRANULES

(71) Applicant: GUANGDONG YIFANG PHARMACEUTICAL CO., LTD, Foshan (CN)

(72) Inventors: Dengping Tan, Foshan (CN); Xueren Cheng, Foshan (CN); Mei Wei, Foshan (CN); Xiangdong Chen, Foshan (CN)

(73) Assignee: GUANGDONG YUFANG PHARMACEUTICAL CO., LTD., Foshan (CN)

( * ) Notice: Subject to any disclaimer, the term of this patent is extended or adjusted under 35 U.S.C. 154(b) by 493 days.

(21) Appl. No.: 16/485,145

(22) PCT Filed: Aug. 2, 2018

(86) PCT No.: PCT/CN2018/098325
§ 371 (c)(1),
(2) Date: Aug. 9, 2019

(87) PCT Pub. No.: WO2019/165754
PCT Pub. Date: Sep. 6, 2019

(65) Prior Publication Data

US 2022/0002008 A1 Jan. 6, 2022

(30) Foreign Application Priority Data

Mar. 1, 2018 (CN) ..... 201810170174.0

(51) Int. Cl.

| | |
|---|---|
| ***B65B 1/30*** | (2006.01) |
| ***B65D 47/26*** | (2006.01) |
| ***B65D 83/06*** | (2006.01) |

(52) U.S. Cl.
CPC ..... *B65B 1/30* (2013.01); *B65D 47/265* (2013.01); *B65D 83/06* (2013.01); *B65D 2203/10* (2013.01)

(58) Field of Classification Search
CPC .. B65D 47/265; B65D 83/06; B65D 2203/10; B65D 47/263; B65D 47/266; B65B 1/30; G01F 11/24; A47J 31/404
(Continued)

(56) References Cited

U.S. PATENT DOCUMENTS 4,832,235 A * 5/1989 Palmer ..... A47G 19/24 222/370
9,976,891 B1 * 5/2018 Fanton ..... G01F 11/42

FOREIGN PATENT DOCUMENTS

CA 2476860 A1 2/2006
CN 105253473 A 1/2016
(Continued)

OTHER PUBLICATIONS

International Search Report, dated Nov. 15, 2018 for corresponding International Application No. PCT/CN2018/098325.
(Continued)

*Primary Examiner* — Vishal Pancholi
*Assistant Examiner* — Robert K Nichols, II
(74) *Attorney, Agent, or Firm* — Intellectual Property Law Group LLP

(57) ABSTRACT

A measuring device of Chinese medicine granules includes a dispensing tray, a fixed discharging cover, a discharging driving cover, and a discharging anti-blocking structure mounted coaxially. The dispensing tray, the fixed discharging cover, and the discharging driving cover are provided with storage holes, measuring holes, and discharging holes, respectively. The discharging anti-blocking structure includes a bottom case, a briquetting holder, an anti-block-
(Continued)

ing briquette, a spring, and a cover. The bottom case is fixed on the dispensing tray and offsets from the storage hole. The bottom case is provided with dispensing holes therein positioned corresponding to the discharging holes. Each of the dispensing holes is provided with one anti-blocking briquette therein. The briquetting holder is connected to the anti-blocking briquette and is disposed in the bottom case. The spring is sleeved on the briquetting holder and is in contact with the cover.

7 Claims, 3 Drawing Sheets

(58) Field of Classification Search
USPC ..... 222/504, 502, 555, 557, 562; 221/174, 221/265, 7
See application file for complete search history.

(56) References Cited

FOREIGN PATENT DOCUMENTS

| | | |
|---|---|---|
| CN | 205045090 U | 2/2016 |
| CN | 20644681 | 8/2017 |
| CN | 108341280 A | 7/2018 |

OTHER PUBLICATIONS

Written Opinion of the ISA, dated Nov. 15, 2018 for corresponding International Application No. PCT/CN2018/098325.
International Search Report, dated Nov. 15, 2018 for corresponding International Application No. PCT/CN2018/098325 with English translation (7 pages).
Written Opinion of the ISA, dated Nov. 15, 2018 for corresponding International Application No. PCT/CN2018/098325 with English translation (9 pages).

* cited by examiner

MEASURING DEVICE OF CHINESE MEDICINE GRANULES

CROSS-REFERENCE TO RELATED APPLICATIONS

This application is a U.S. National Phase application, under 35 U.S.C. § 371, of International Application no. PCT/CN2018/098325, with an international filing date of Aug. 2, 2018, and claims benefit of China Application no. CN 201810170174.0 filed on Mar. 1, 2018; each of which is hereby incorporated by reference for all purposes.

TECHNICAL FIELD

The present disclosure relates to the field of pharmaceutical production technology, and more particularly relates to a measuring device of Chinese medicine granules.

BACKGROUND

The research on granulation of Chinese medicine at home and abroad is mainly manifested in two aspects. One is to decoct Chinese medicine powder, that is, to pulverize Chinese medicine decoction pieces into granules with a certain granularity, to improve the decocting efficiency, increase the curative effect, and save Chinese medicine resources. The other is single-flavor or compound concentrated extractum granules, that is, using modern science and technology, combined with processing, medicament, phytochemistry and other modern scientific research achievements, the single-flavor Chinese medicine or traditional classic compound can be directly extracted and concentrated into the extractum, and then processed into granules for direct use by patients.

At present, the production process of Chinese medicine has been normalized and standardized. In the prescription dispensing process of Chinese medicine granules, in addition to the traditional method of hand-grasping and weighing, an automatic measuring device is also used for dispensing. For example, in the Chinese utility model device of the application No. 201520725251.6, an anti-adhesive measuring device of Chinese medicine granules including a dispensing tray, a fixed discharging cover, and a discharging driving cover is disclosed. The dispensing tray and the discharging driving cover are sleeved on an inner side and an outer side of the fixed discharging cover, respectively. The dispensing tray and the discharging driving cover are fixed connected and capable of rotating about a central axis. The dispensing tray, the fixed discharging cover, and the discharging driving cover are provided with the same quantity of storage holes, measuring holes, and discharging holes, respectively. The storage holes and the discharging holes have larger sizes than those of the measuring holes. When the discharging driving cover is rotated, the storage holes can be in communication with the measuring holes, or the measuring holes can be being in communication with the discharging holes. The measuring device is used in cooperation with the discharging vessel to perform quantitative discharging through offsetting communication between the storage hole, the measuring hole, and the discharging hole. Although it can meet the basic demands of quantitative drug administration, the following problems still exist in practical use: 1. Since the Chinese medicine granules fall into the measuring holes first to fill the measuring hole as a unit of measurement. When the measuring hole is rotated to be in communication with the discharging hole, the Chinese medicine granules fall under the force of gravity, and there is no problem under normal conditions. However, it is sometimes affected by the inertia and the squeezing between the Chinese medicine granules. When the measuring hole is in communication with the discharging hole, all or part of the Chinese medicinal granules are still agglomerated and blocked in the measuring hole, which leads to inaccurate measurement and affects the prescription effect. 2. During the rotation process, the Chinese medicine granules are transferred from the storage hole to the measuring hole and then to the discharging hole, and there is still a gap between the dispensing tray and the fixed discharging cover after the connection. Since the Chinese medicine granules are tiny, they will enter into the aforementioned gap, as more and more granules enter into the gap, the gap will be blocked, and the problem of jamming and damage is easily to occur.

SUMMARY

The object of the present disclosure is to provide a measuring device of Chinese medicine granules with a compact structure and an accurate measurement.

In order to achieve the above object, the technical solution adopted by the present disclosure is a measuring device of Chinese medicine granules, which includes a dispensing tray, a fixed discharging cover, and a discharging driving cover mounted coaxially. The dispensing tray and the discharging driving cover are sleeved on an inner side and an outer side of the fixed discharging cover, respectively. The dispensing tray and the discharging driving cover are fixedly connected and capable of rotating about a central axis. The dispensing tray, the fixed discharging cover, and the discharging driving cover are provided with the same quantity of storage holes, measuring holes, and discharging holes, respectively. The storage holes and the discharging holes have larger sizes than those of the measuring holes. When the discharging driving cover is rotated, the storage holes are in communication with the measuring holes, or the measuring holes are in communication with the discharging holes. The dispensing tray is further provided with a discharging anti-blocking structure, and the discharging anti-blocking structure includes a bottom case, a briquetting holder, an anti-blocking briquette, a spring, and a cover matched with the bottom case. The bottom case is fixed on the dispensing tray and offsets from the storage hole. The bottom case is provided with dispensing holes therein positioned directly above the discharging holes. Each of the dispensing holes is provided with one anti-blocking briquette therein. The briquetting holder is disposed in the bottom case and fixedly connected to the anti-blocking briquette. The spring is sleeved on a center of the briquetting holder, and a free end of the spring is in contact with the cover. An edge of a bottom surface of the anti-blocking briquette is provided with a round chamfer. Under an action of the spring, the anti-blocking briquette is capable of being in contact with an inner bottom surface of the fixed discharging cover through the dispensing hole. During a rotation of the discharging driving cover, the round chamfer of the anti-blocking briquette is capable of sliding into and out of the measuring hole.

In addition, the measuring device of Chinese medicine granules further includes a tag holder, the radio frequency identification (RFID) tag holder is composed by a hollow frame and a top cover matched with the frame. The frame is fixed onto the cover of the discharging anti-blocking structure.

In addition, there are six storage holes, six measuring holes, and six discharging holes, and the bottom case has a shape of "*" and is integrally formed with the dispensing tray. The briquetting holder and the anti-blocking briquette are integrally formed.

In addition, the fixed discharging cover is provided with a mounting through hole at a center of a bottom surface thereof. The measuring holes are uniformly arranged along an outer side of an edge of the mounting through hole. A bottom surface of the discharging driving cover is provided with a circular flange adapted to a size of the mounting through hole. The circular flange is provided with a polygonal latching groove and a mounting post disposed on a center of the bottom surface of the discharging driving cover. A bottom surface of the dispensing tray is provided with a polygonal latching flange matched with the polygonal latching groove, and a center of the dispensing tray is fixed to the mounting post by a screw.

In addition, the inner bottom surface of the fixed discharging cover and an inner bottom surface of the discharging driving cover are provided with annular guiding grooves. An outer bottom surface of the fixed discharging cover and a lower surface of the dispensing tray are provided with annular latching flanges latched in the corresponding annular guiding grooves, respectively. The storage holes are disposed in the annular latching flange of the dispensing tray. The measuring holes and the discharging holes are disposed in the corresponding annular guiding grooves.

In addition, the fixed discharging cover is provided with a mounting thread on an inner side wall thereof and is provided with a positioning anti-rotation lug on an outer side wall thereof. The discharging driving cover is provided with a rotating limiting rib on an outer side wall thereof.

The present disclosure has the advantages of a compact structure and has the advantages of dustproof, moisture proof, and accurate measurement when using with the discharging vessel.

Specifically, by providing a discharging anti-blocking structure, under the action of the spring, the anti-blocking briquette may be in contact with and slid on the inner bottom surface of the fixed discharging cover. During a rotation and the dispensing, the Chinese medicine granules enter into the measuring holes through the storage holes. When the measuring holes and the discharging holes are aligned with each other, the round chamfer of the anti-blocking briquette slides into the measuring holes and collides with the Chinese medicine granules in the measuring holes, so that the Chinese medicine granules move downwards and are discharged through the discharging holes, thereby avoiding the situation that the Chinese medicine granules are stuck in the measuring holes. In addition, since the anti-blocking briquette slides by being in contact with a contact surface, the Chinese medicine granules remaining in the connection gap between the components may move along the anti-blocking briquette, and fall into the measuring holes, thereby ensuring the accuracy of the measurement results and avoiding the phenomenon of component jamming.

BRIEF DESCRIPTION OF THE DRAWINGS

The present disclosure is further described in detail below with reference to the accompanying drawings.

DETAILED DESCRIPTION OF THE EMBODIMENTS

Figure 1:
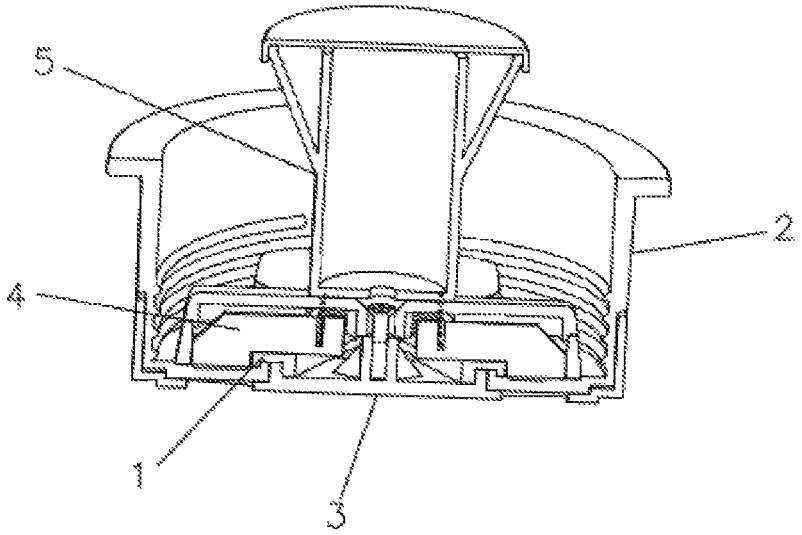
FIG. 1 is a schematic view of the present disclosure.
Figure 2:
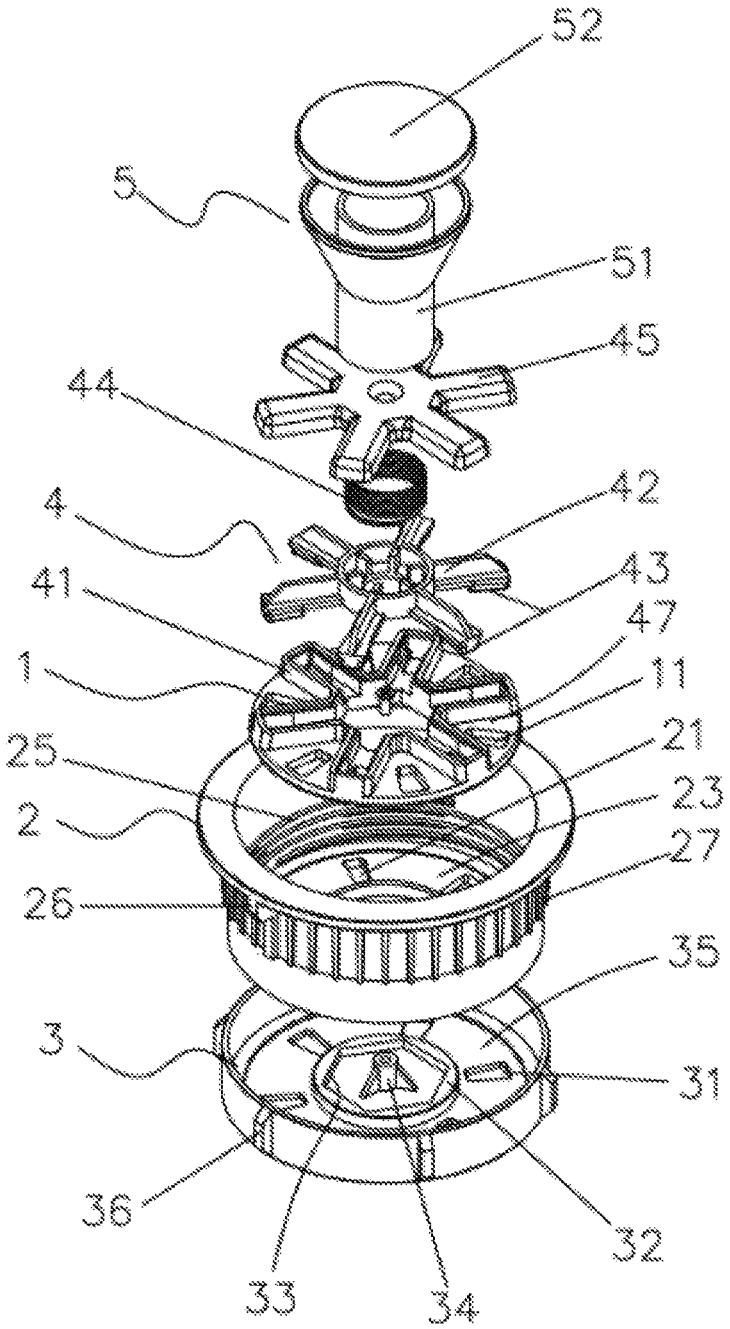
FIG. 2 is an exploded view of the present disclosure.
Figure 3:
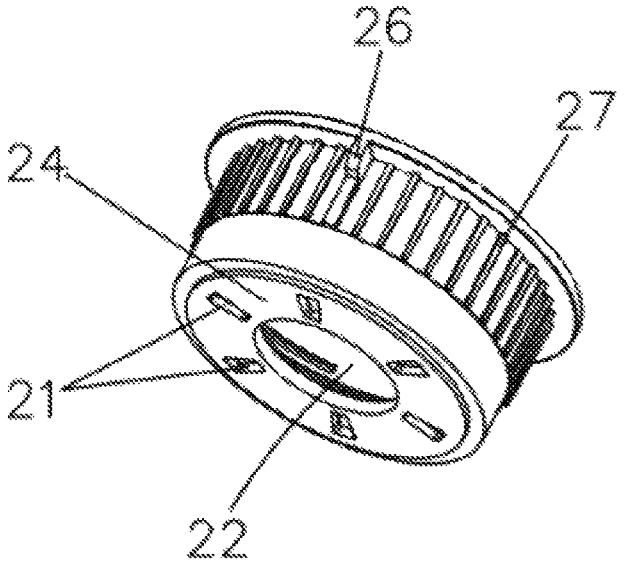
FIG. 3 is a schematic view of a bottom surface of a dispensing tray according to the present disclosure.
Figure 4:
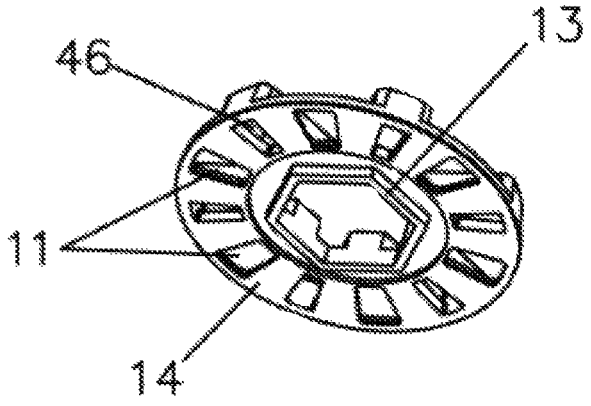
FIG. 4 is a schematic view of a fixed discharging cover according to the present disclosure.

Referring to FIGS. 1 to 4, a measuring device of Chinese medicine granules in accordance with the present disclosure includes a dispensing tray 1, a fixed discharging cover 2, and a discharging driving cover 3 mounted coaxially. The dispensing tray 1 and the discharging driving cover 3 are sleeved on an inner side and an outer side of the fixed discharging cover 2, respectively. The dispensing tray 1 and the discharging driving cover 3 are fixedly connected and capable of rotating about a central axis. The dispensing tray 1, the fixed discharging cover 2, and the discharging driving cover are provided with the same quantity of storage holes 11, measuring holes 21, and discharging holes 31, respectively. The storage holes 11 and the discharging holes 31 have larger sizes than those of the measuring holes 21. When the discharging driving cover 3 is rotated, the storage holes 11 can be in communication with the measuring holes 21, or the measuring holes 21 can be in communication with the discharging holes 31.

The dispensing tray 1 is further provided with a discharging anti-blocking structure 4. The discharging anti-blocking structure 4 includes a bottom case 41, a briquetting holder 42, an anti-blocking briquette 43, a spring 44, and a cover 45 matched with the bottom case. The bottom case 41 is fixed on the dispensing tray 1 and offsets from the storage hole 11, that is, the bottom case 41 does not block the storage hole 11. The bottom case 41 is provided with dispensing holes 46 therein, which are positioned directly above the discharging holes 31. Each of the dispensing holes 46 is provided with one anti-blocking briquette 43 therein.

The briquetting holder 42 is disposed in the bottom case and fixedly connected to the anti-blocking briquette 43. The spring 44 is sleeved on a center of the briquetting holder 42 and a free end of the spring 44 is in contact with the cover 45. An edge of a bottom surface of the anti-blocking briquette 43 is provided with a round chamfer. Under the action of the spring 44, the bottom surface of the anti-blocking briquette 43 may be in contact with an inner bottom surface of the fixed discharging cover 2 through the dispensing hole. During a rotation of the discharging driving cover 3, the round chamfer of the anti-blocking briquette 43 may slide into and out of the measuring hole 21.

In addition, the measuring device of Chinese medicine granules in accordance with the present disclosure further includes a tag holder 5. The tag holder 5 is composed by a hollow frame 51 and a top cover 52 matched with the frame. The frame 51 is fixed onto the cover 45 of the discharging anti-blocking structure. By providing the tag holder 5, a radio frequency identification (RFID) can be placed in the hollow frame 51 for identification and verification by the discharging device.

In addition, there are six storage holes 11, six measuring holes 21, six discharging holes 31, and six dispensing holes 46.

The bottom case 41 has a shape of "*" and is integrally formed with the dispensing tray. Six storage cavities 47 are formed between an outer side of the bottom case 41 having the shape of "*" and the dispensing tray. Each of the storage cavities 47 is provided with one storage hole 11 on a bottom surface thereof.

In addition, the briquetting holder 42 and the anti-blocking briquette 43 are integrally formed.

In the present embodiment, the aforementioned fixed discharging cover 2 is further provided with a mounting through hole 22 at a center of a bottom surface thereof. The aforementioned measuring holes 21 are uniformly arranged along an outer side of an edge of the mounting through hole 22. A bottom surface of the aforementioned discharging driving cover 3 is provided with a circular flange 32 adapted to a size of the mounting through hole 22. The circular flange 32 is provided with a polygonal latching groove 33 and a mounting post 34 disposed on the center of the bottom surface of the discharging driving cover 3. A bottom surface of the dispensing tray 1 is provided with a polygonal latching flange 13 matching with the polygonal latching groove 33. When mounting the dispensing tray 1, the polygonal latching flange 13 of the dispensing tray 1 is engaged with the polygonal latching groove 33, and the dispensing tray 1 is fixed to the mounting post 34 by a screw passing through the cover 45 and the dispensing tray 1.

In addition, the inner bottom surface of the fixed discharging cover 2 is provided with a first annular guiding groove 23, and an inner bottom surface of the discharging driving cover 3 is provided with a second annular guiding groove 35. The fixed discharging cover 2 is provided with a first annular latching flange 24 on an outer bottom surface thereof. The first annular latching flange 24 can be latched in the second annular guiding groove 35. A lower surface of the dispensing tray 1 is provided with a second latching flange 14 latched in the first annular guiding groove 23. The aforementioned storage holes 11 are disposed in an area of the second annular latching flange 14 of the dispensing tray 1, the measuring holes 21 are disposed in the first annular guiding groove 23, and the discharging holes 31 are disposed in the second annular guiding groove 35. By providing the first annular guiding groove 23 and the second annular guiding groove 35, the movement trajectory of the medicine granules may be restricted in the annular guiding grooves, thereby preventing the external dispersion to hinder the rotation.

In addition, the aforementioned fixed discharging cover 2 is provided with a mounting thread 25 on an inner side wall thereof and is provided with a positioning anti-rotation lug 26 and anti-slip ribs 27 on an outer side wall thereof. The anti-slip ribs 27 are uniformly distributed on the outer side wall. The aforementioned discharging driving cover 3 is provided with rotating limiting ribs 36 on an outer side wall thereof.

When the measuring device of Chinese medicine granules in accordance with the present disclosure is used, the fixed discharging cover 2 is threadedly connected to a discharging port of a discharging vessel. After turning over the measuring device, the positioning anti-rotation lug 26 on the fixed discharging cover 2 is tightly latched and fixed to the station of a peripheral leakage device, and the rotating limiting rib 36 is inserted into a latching groove of a rotary driving component of the peripheral leakage device, and driven to rotate by a servo motor. When the storage holes 11 are in communication with the measuring holes 21, the medicine granules in the discharging vessel fall into the measuring holes 21. When the measuring device is further rotated, when the measuring holes 21 are aligned and in communication with the discharging holes 31, the round chamfer of the anti-blocking briquette 43 slides into the measuring holes 21 and collides with the Chinese medicine granules in the measuring holes, causing the Chinese medicine granules to move downwards and fall down through the discharging holes 31. The rotation and the discharging are repeated until the discharging amount is fulfilled. The servo motor stops rotating.

Since the measuring holes 21 are disposed on the fixed discharging cover 2 located in the middle layer, this portion is stay still during operation. The relative movement between the dispensing tray and the discharging driving cover which are fixedly connected and rotated about the central axis ensures the smoothness of the rotation and makes the measurement of the Chinese medicine granules more accurate.

The above description is only used for illustrating the technical solutions of the present disclosure, and is not intended to limit the protection scope of the present disclosure. Simple modification or equivalent replacement can be made by those skilled in the art to the technical solutions of the present disclosure, without departing from the essence and the scope of the technical solutions of the present disclosure.

What is claimed is:

1. A measuring device of Chinese medicine granules, comprising a dispensing tray, a fixed discharging cover, and a discharging driving cover mounted coaxially, wherein the dispensing tray and the discharging driving cover are sleeved on an inner side and an outer side of the fixed discharging cover, respectively; the dispensing tray and the discharging driving cover are fixedly connected and capable of rotating about a central axis, the dispensing tray, the fixed discharging cover, and the discharging driving cover are provided with the same quantity of storage holes, measuring holes, and discharging holes, respectively; the storage holes and the discharging holes have larger sizes than those of the measuring holes, when the discharging driving cover is rotated, the storage holes are in communication with the measuring holes, or the measuring holes are in communication with the discharging holes;

wherein the dispensing tray is further provided with a discharging anti-blocking structure, the discharging anti-blocking structure comprises a bottom case, a briquetting holder, an anti-blocking briquette, a spring, and a cover matched with the bottom case, the bottom case is fixed on the dispensing tray and offsets from the storage hole, the bottom case is provided with dispensing holes therein positioned directly above the discharging holes, each of the dispensing holes is provided with one anti-blocking briquette therein, the briquetting holder is disposed in the bottom case and fixedly connected to the anti-blocking briquette, the spring is sleeved on a center of the briquetting holder and a free end thereof is in contact with the cover, an edge of a bottom surface of the anti-blocking briquette is provided with a round chamfer; under an action of the spring, the anti-blocking briquette is capable of being in contact with an inner bottom surface of the fixed discharging cover through the dispensing holes, and during a rotation of the discharging driving cover, the round chamfer of the anti-blocking briquette is capable of sliding into and out of the measuring holes.

2. The measuring device of Chinese medicine granules according to claim 1, further comprising a radio frequency identification (RFID) tag holder defined by a hollow frame and a top cover matched with the hollow frame, the hollow frame being fixed onto the cover of the discharging anti-blocking structure.

3. The measuring device of Chinese medicine granules according to claim 1, wherein there are six storage holes, six measuring holes, and six discharging holes, the bottom case has a shape of "*" and is integrally formed with the dispensing tray.

4. The measuring device of Chinese medicine granules according to claim 1, wherein the briquetting holder and the anti-blocking briquette are integrally formed.

5. The measuring device of Chinese medicine granules according to claim 4, wherein the fixed discharging cover is provided with a mounting through hole at a center of a bottom surface thereof, the measuring holes are uniformly arranged along an outer side of an edge of the mounting through hole; a bottom surface of the discharging driving cover is provided with a circular flange adapted to a size of the mounting through hole, the circular flange is provided with a polygonal latching groove and a mounting post disposed on a center of the bottom surface of the discharging driving cover, a bottom surface of the dispensing tray is provided with a polygonal latching flange matched with the polygonal latching groove, and a center of the dispensing tray is fixed to the mounting post by a screw.

6. The measuring device of Chinese medicine granules according to claim 4, wherein the inner bottom surface of the fixed discharging cover and an inner bottom surface of the discharging driving cover are provided with annular guiding grooves, an outer bottom surface of the fixed discharging cover and a lower surface of the dispensing tray are provided with annular latching flanges latched in the corresponding annular guiding grooves, respectively; the storage holes are disposed in the annular latching flange of the dispensing tray, and the measuring holes and the discharging holes are disposed in the corresponding annular guiding grooves.

7. The measuring device of Chinese medicine granules according to claim 4, wherein the fixed discharging cover is provided with a mounting thread on an inner side wall thereof and is provided with a positioning anti-rotation lug on an outer side wall thereof, and the discharging driving cover is provided with a rotating limiting rib on an outer side wall thereof.

* * * * *